US012459710B2

(12) United States Patent
Lin et al.

(10) Patent No.: US 12,459,710 B2
(45) Date of Patent: Nov. 4, 2025

(54) MAGNETIC CUP CAP

(71) Applicant: Xiamen CHUFUNYU Co., Ltd., Fujian (CN)

(72) Inventors: Kuan-Yu Lin, Fujian (CN); Heng-Yu Lin, Fujian (CN)

(73) Assignee: Xiamen CHUFUNYU Co., Ltd., Xiamen (CN)

( * ) Notice: Subject to any disclaimer, the term of this patent is extended or adjusted under 35 U.S.C. 154(b) by 99 days.

(21) Appl. No.: 18/485,105

(22) Filed: Oct. 11, 2023

(65) Prior Publication Data

US 2025/0121992 A1 Apr. 17, 2025

(51) Int. Cl.
*B65D 47/08* (2006.01)

(52) U.S. Cl.
CPC ..... *B65D 47/08* (2013.01); *B65D 2313/04* (2013.01)

(58) Field of Classification Search
CPC .... B65D 47/08; B65D 2313/04; B65D 51/18; A47G 19/2272; A47J 36/2444
See application file for complete search history.

(56) References Cited

U.S. PATENT DOCUMENTS

| | | | | |
|---|---|---|---|---|
| 10,124,942 | B2 * | 11/2018 | Seiders | B29C 45/02 |
| 10,232,993 | B2 * | 3/2019 | Seiders | A47G 19/2272 |
| 10,669,081 | B2 * | 6/2020 | Sullivan | B65D 47/121 |
| 11,767,149 | B2 * | 9/2023 | Sullivan | B65D 47/121 220/254.8 |
| 2013/0320013 | A1 * | 12/2013 | Bratsch | B65D 47/286 220/270 |
| 2017/0121074 | A1 * | 5/2017 | Seiders | B65D 47/286 |

FOREIGN PATENT DOCUMENTS

| | | |
|---|---|---|
| TW | I802424 B | 5/2023 |

* cited by examiner

*Primary Examiner* — Kareen K Thomas
(74) *Attorney, Agent, or Firm* — Cooper Legal Group, LLC

(57) ABSTRACT

A magnetic cup cap comprising a body and a cap body is provided, wherein the body includes a board body, an annular wall extends upwards from the circumference of the board body, a connecting portion extends downwards from a circumference of the board body, at least one liquid outlet is provided on an upper surface of the board body, and a first sealing structure is annularly provided on a circumference of the liquid outlet; the cap body is used for capping the board body, and the cap body and the board body are magnetically engaged, the cap body is provided with a second sealing structure, and cooperation between the first and the second sealing structures is cooperation between an annular flange and a planar surface.

20 Claims, 15 Drawing Sheets

Partial enlarged view A

MAGNETIC CUP CAP

TECHNICAL FIELD

The present invention relates to the field of cups, in particular to a magnetic cup cap.

BACKGROUND

For existing cup caps on the market, a liquid outlet of a cup is mostly opened by lifting a spiral integrated cap or a buckled cap which must be opened by holding a cup body by one hand while operating the cup cap by the other hand. There is also a sliding cup cap on the market, with the liquid outlet being opened by a single hand, but such cup cap sacrifices sealing performance of the cup cap for the convenience of sliding, and the liquid in the cup easily flows out.

Taiwan patent No. TW 1802424B provides a cup cap including a board body and a cap body, wherein the cap body is pivotably provided with respect to the body and is pivoted with respect to the board body by pressing downwards, and the board body and the cap body are both provided with a magnet, and the board body and the cap body are magnetically engaged.

The board body is provided with a water outlet, the cap body is provided with a seal corresponding to the water outlet, the seal closes or opens the water outlet when the cap body pivots relative to the board body to achieve the purpose of opening the water outlet by a single hand, and the problem of insufficient sealing of a sliding cap structure is solved by using a magnetic engagement sealing. However, the inventors of the present invention have found that the cup cap has several problems in using a water cup having the cup cap as follows:

firstly, in order to achieve a pivotable connection between the cap body and the board body, a gap between an outer side wall of the cap body and an annular wall of the board body is relatively large, and the cap body has a relatively large moving space when cooperating with the board body, which results in that the seal between the seal of the cup cap and the water outlet may be misaligned, and the liquid easily flows out;

secondly, the cooperation between the seal and the water outlet is an annular surface cooperation, and the required accuracy of the face-to-face cooperation is very high, especially for the surfaces which are parallel to each other or about to parallel to each other, if one of the sides is tilted with respect to the other side, sealing of the tilted side is not tight and the liquid flows out easily.

In view of the above, there is a need for a new cup cap that addresses the above problems.

SUMMARY

The present invention is to overcome the problem of insufficient sealing of a cup cap in the prior art, and to provide a magnetic cup cap which has a good sealing effect and is not easy to leak.

The technical solution of the present invention is a magnetic cup cap including a body and a cap body, wherein the body includes a board body, an annular wall extends upwards from the circumference of the board body, a connecting portion extends downwards from a circumference of the board body, at least one liquid outlet is provided on an upper surface of the board body, and a first sealing structure is annularly provided on a circumference of the liquid outlet; the cap body is used for capping the board body, and the cap body and the board body are magnetically engaged, the cap body is provided with a second sealing structure, and the cooperation between the first and the second sealing structures is the one of an annular flange and a planar surface.

The present invention overcomes the problem of poor sealing and leakage caused by the existing face-to-face cooperation by changing the sealing of the liquid outlet to an annular flange cooperation with a planar surface. Secondly, the present invention divides a profile of a flow guide portion of the liquid outlet into a drainage section and a first sealing section, and a slope of the first sealing section is less than that of the drainage section, so that the sealing surface of the first sealing structure is more gentle, and the sealing of the liquid outlet can also be maintained to a certain extent in a case where an installation position of the second sealing structure is inaccurate, and the drainage section makes a side wall of the liquid outlet more steep, which facilitates the outflow of liquid and also avoids the accumulation of liquid on the flow guide portion. Finally, the present invention reduces a relative movement space between the cap body and the board body by setting the cooperation between a first connecting structure end portion and a second connecting structure end portion as a planar surface-to-planar surface cooperation, improves the cooperation accuracy with the first and the second sealing structures, and reduces the probability of liquid leakage from the existing cup cap, relative to the existing sphere-to-sphere cooperation.

Figure 1:
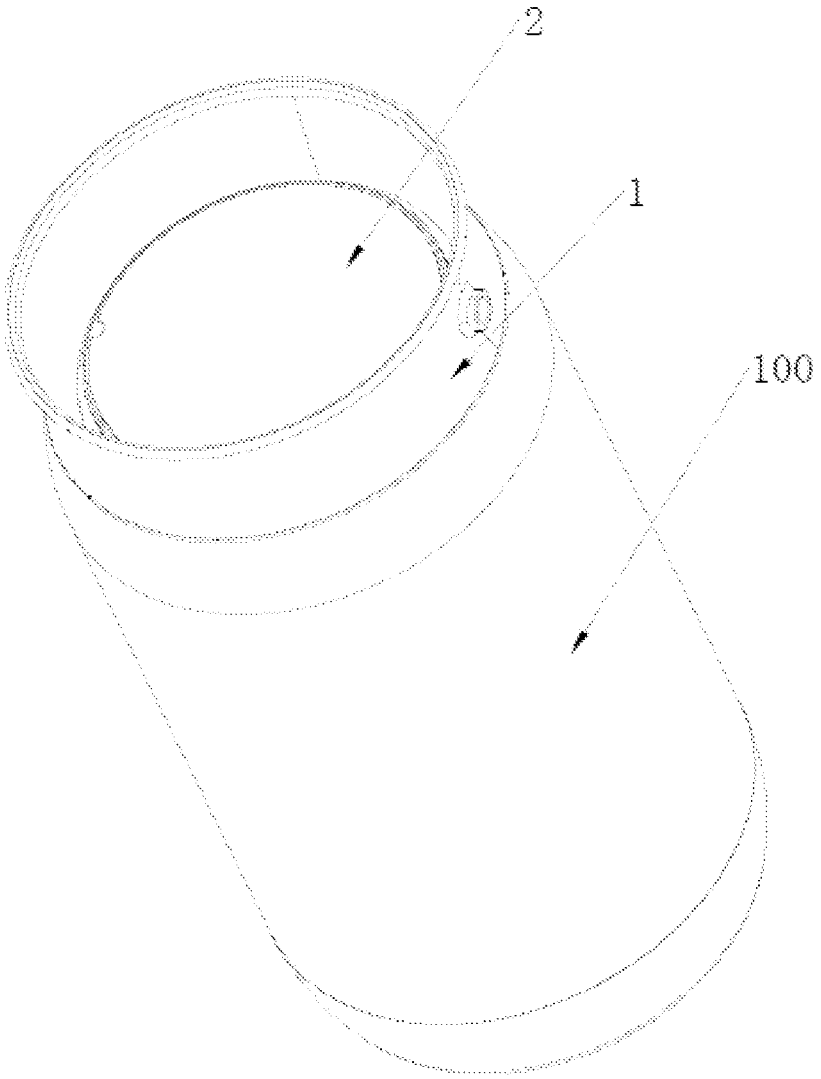
FIG. 1 is a schematic diagram showing cooperation between a cup cap and a cup body according to an embodiment of the present invention.
Figure 2:
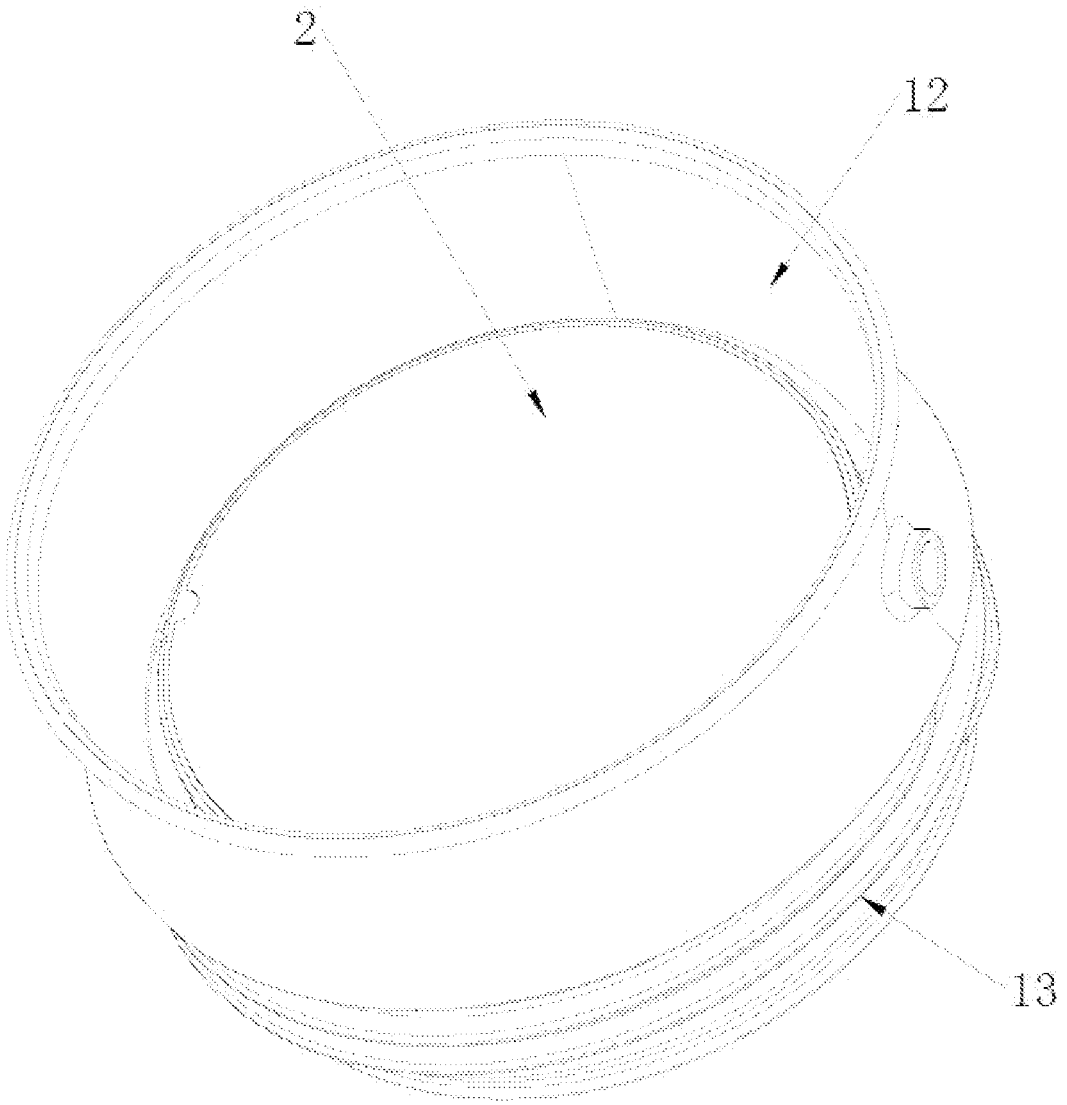
FIG. 2 is a perspective view showing a cup cap according to an embodiment of the present invention.

| Reference numerals: | | |
|---|---|---|
| 1 body | 114 cooperation portion | 40 second sealing structure |
| 10 first connecting structure | 1141 second sealing section | 5 magnetic member |
| 11 board body | 12 annular wall | 6 seal |
| 111 first closing portion | 13 connecting portion | 61 mounting portion |
| 112 first opening portion | 2 cap body | 62 sealing portion |
| 113 flow guide portion | 20 second connecting structure | 100 cup body |
| 1131 drainage section | 21 second closing portion | 101 liquid outlet |
| 1132 first sealing section | 22 second opening portion | 102 gas outlet gap D |
| 1133 transition section | 30 first sealing structure | |

DESCRIPTION OF EMBODIMENTS

As shown in FIGS. 1 to 4, the present invention discloses a magnetic cup cap including a body 1 and a cap body 2, wherein the body 1 includes a board body 11, an annular wall 12 extends upwards from the circumference of the board body 11, a connecting portion 13 extends downwards from a circumference of the board body 11, a liquid outlet 101 and two gas outlets 102 are provided on an upper surface of the board body 11, and a first sealing structure 30 is annularly provided on a circumference of the liquid outlet 101 and the gas outlets 102. The cap body 2 is used for capping the board body 11, and the cap body 2 and the board body 11 are magnetically engaged; the cap body 2 is provided with a second sealing structure 40, and the cooperation between the first and second sealing structures 30, 40 is an extruded cooperation between an annular flange and a planar surface. The outer periphery of the connecting portion 13 of the body 1 is provided with a screw thread, is used for forming a screw thread cooperation with the cup body 100, and is sleeved with a sealing ring to form a sealed connection between the connecting portion 13 and the cup body 100. The cup body 100 is used for holding water or a liquid such as tea or fruit juice.

In this example, one liquid outlet 101 and two gas outlets 102 are provided, and the liquid outlet 101 is eccentrically provided near an edge of the board body 11 near the annular wall, so that the liquid in the cup body 100 flows out sufficiently during drinking, and air can enter the cup body through the gas outlet 102 during drinking, and the pressure difference between the inside and the outside of the cup body 100 is balanced, so that the liquid in the cup body 100 flows out smoothly. In other embodiments, the number of the liquid outlet 101 and the gas outlet 102 is not limited to one or two, and may be one, two, three, or more, but the liquid outlet 101 should be eccentrically provided at a position near an edge of the board body 11 and near the annular wall.

In this example, the gas outlet 102 is sealed by cooperating the annular flange with a planar surface. In other embodiments, the sealing may be accomplished using a face-to-face cooperation in the prior art.

Figure 3:
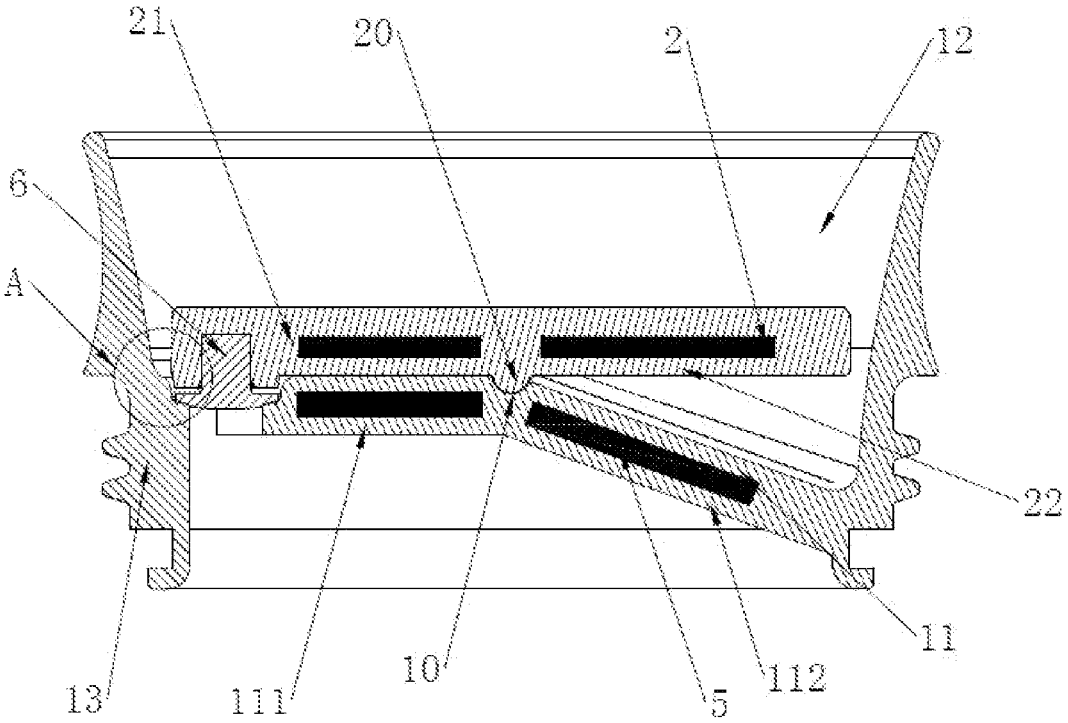
FIG. 3 is a cross-sectional view showing a cup cap according to an embodiment of the present invention.

As shown in FIG. 3, the board body 11 is provided with a first connecting structure 10, the cap body 2 is provided with a second connecting structure 20, and the first connecting structure 10 and the second connecting structure 20 cooperate to enable the board body 11 and the cap body 2 to form a hinged connection. The board body 11 has a first closing portion 111 and a first opening portion 112 bounded by the first connecting structure 10, and the cap body 2 has a second closing portion 21 and a second opening portion 22 bounded by the second connecting structure 20. The liquid outlet 101 and the gas outlet 102 are provided on the first closing portion 111 of the board body 11, a first sealing structure 30 is provided on an outer circumference of each liquid outlet 101 and each gas outlet 102, and the second sealing structure 40 is provided on the second closing portion 21 of the cap body 2. When the cap body 2 and the board body 11 are magnetically engaged by the magnetic engagement, the first closing portion 111 of the board body 11 and the second closing portion 21 of the cap body 2 are magnetically engaged, and the first and second sealing structures 30, 40 form a sealing cooperation, preventing the liquid in the cup body 100 from flowing out from the liquid outlet 101 and the gas outlet 102.

The first opening portion 112 is oblique downward with respect to the first closing portion 111, and the lower surface of the cap body 2 is a planar surface, i.e., the lower surface of the second closing portion 21 is parallel with and the lower surface of the second opening portion 22. When the first and second closing portions 111, 21 are magnetically engaged, the first and second opening portions 112, 22 are separated; when the first and second opening portions 112, 22 are magnetically engaged, the first and second closing portions 111, 21 are separated, at this time, the sealing cooperation between the first and second sealing structures 30, 40 is released, and the liquid outlet 101 and the gas outlet 102 are in an open state. Therefore, when it is needed to flow the liquid of the cup body 100 out from the liquid outlet 101, the cooperation between the board body 11 and the cap body 2 is switched to the magnetic engagement of the first and second opening portions 112, 22.

The switching of the magnetic engagement of the cap body 2 and the board body 11 is performed by means of a hinge formed by cooperation between the first connecting structure 10 and the second connecting structure 20, and in this example, a central axis of the hinge extends in the radial direction of the cap body 2. In other embodiments, the central axis may also be in the axial direction of the cap body 2 or in other directions capable of switching the magnetic engagement of the cap body 2 and the board body 11.

In this example, the first closing portion 111 and the first opening portion 112 of the board body 11 are set to have a certain included angle in order to realize the partition cooperation between the board body 11 and the cap body 2

Figure 18:
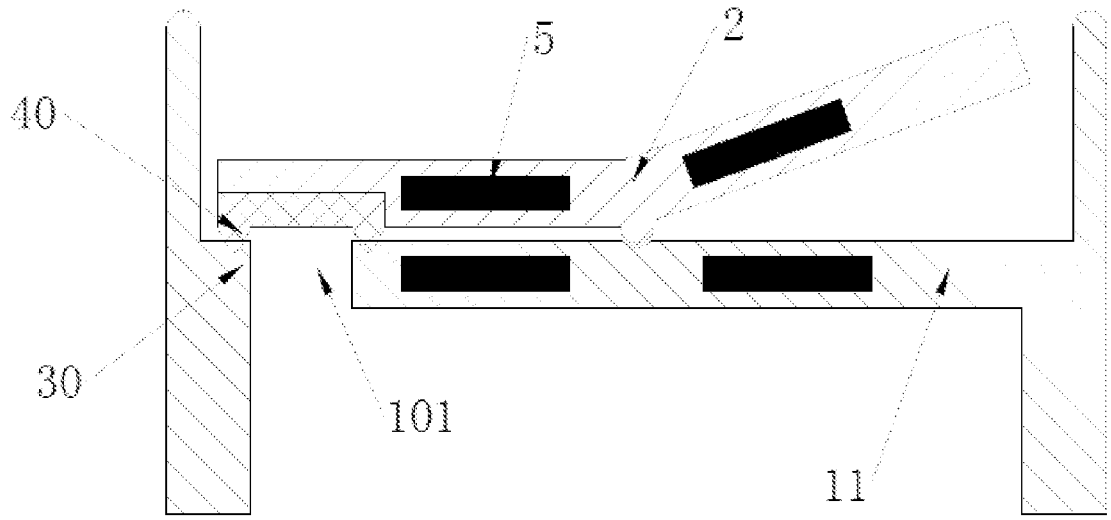
FIG. 18 is a second schematic diagram showing cooperation between the board body and the cap body according to an embodiment of the present invention.
Figure 22:
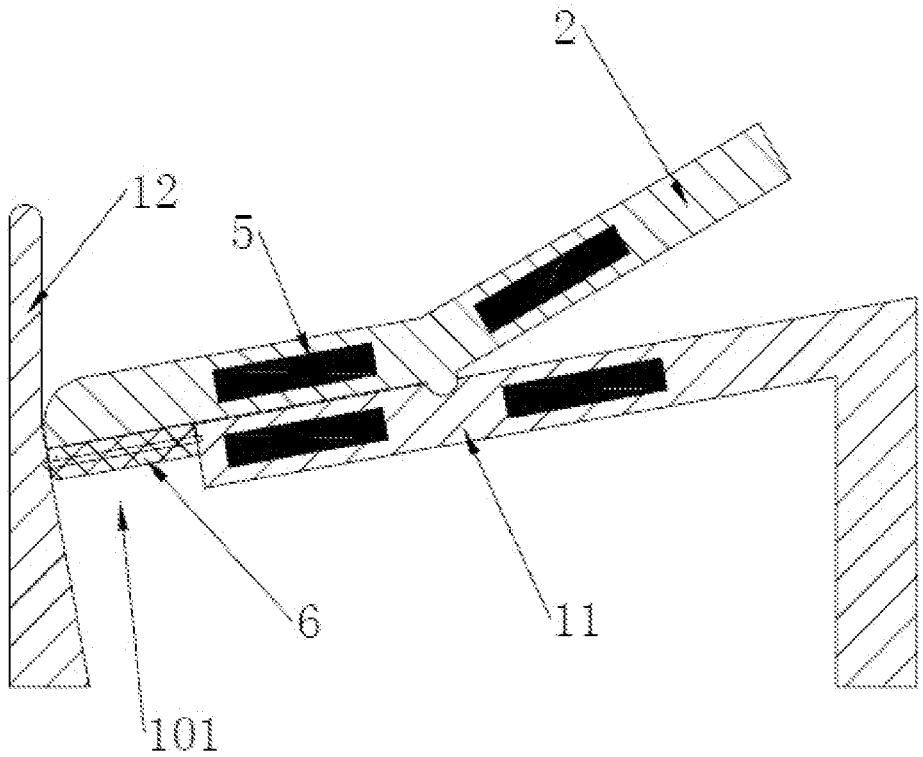
FIG. 22 is a third schematic diagram showing cooperation between the board body and the cap body according to an embodiment of the present invention.

(the first and second closing portions 111, 21 are magnetically engaged or the first and second opening portions 112, 22 are magnetically engaged). In other embodiments, as shown in FIGS. 18 and 22, it is also possible that the second opening portion 22 is oblique upward with respect to the second closing portion 21, and the upper surface of the board body 11 is a planar or oblique surface, i.e., the upper surface of the first closing portion 111 is parallel with the upper surface of the first opening portion 112.

As shown in FIG. 3, both the cap body 2 and the board body 11 are provided with a magnetic member 5, and the magnetic member 5 can be a permanent magnet or a magnetic metal which can be magnetically engaged by the permanent magnet, for example, a first closing portion 111 of the board body 11 and a second closing portion 21 of the cap body 2 are respectively provided with a magnetic member 5, and the magnetic members 5 of both are respectively a permanent magnet and iron; accordingly, the first opening portion 112 of the board body 11 and the second opening portion 22 of the cap body 2 are respectively provided with a magnetic member 5, and the magnetic members 5 of both are respectively a permanent magnet and iron. The magnetic member 5 can make the first and second closing portions 111, 21 or the first and second opening portions 112, 22 magnetically engage each other so that the liquid outlet 101 and the gas outlet 102 are opened or closed as long as at the same time.

Further, the magnetic member 5 provided in the first closing portion 111 and the first opening portion 112 of the board body 11 is a permanent magnet of opposite magnetism, and the magnetic member 5 provided in the second closing portion 21 and the second opening portion 22 of the cap body 2 is also a permanent magnet of opposite magnetism, and the permanent magnets of the first and second closing portions 111, 21 are of opposite magnetism, and the permanent magnets of the first and second opening portions 112, 22 are of opposite magnetism, so that it is possible to achieve an effect of preventing misdirection of the cap body 2. For example, the first closing portion 111 is provided with a negative permanent magnet, the second closing portion 21 is provided with a positive permanent magnet, the first opening portion 112 is provided with a positive permanent magnet, and the second opening portion 22 is provided with a negative permanent magnet.

Since the magnetic lines of force may diffuse outward around the magnetic member, the positioning accuracy of the magnetic engagement cooperation is poor, which may cause the first and second sealing structures 30, 40 to be insufficiently extruded in contact with each other, resulting in leakage of the liquid outlet 101 and the gas outlet 102 of the cup cap. In order to solve this problem, the cooperation positioning between the board body 11 and the cap body 2 achieves further positioning by means of a concave-convex cooperation in addition to a magnetic engagement cooperation, and this example achieves further positioning of the cap body 2 and the board body 11 by forming a concave-convex cooperation with the first connecting structure 10 provided on the upper surface of the board body 11 and the second connecting structure 20 provided on the lower surface of the cap body 2.

Figure 5:
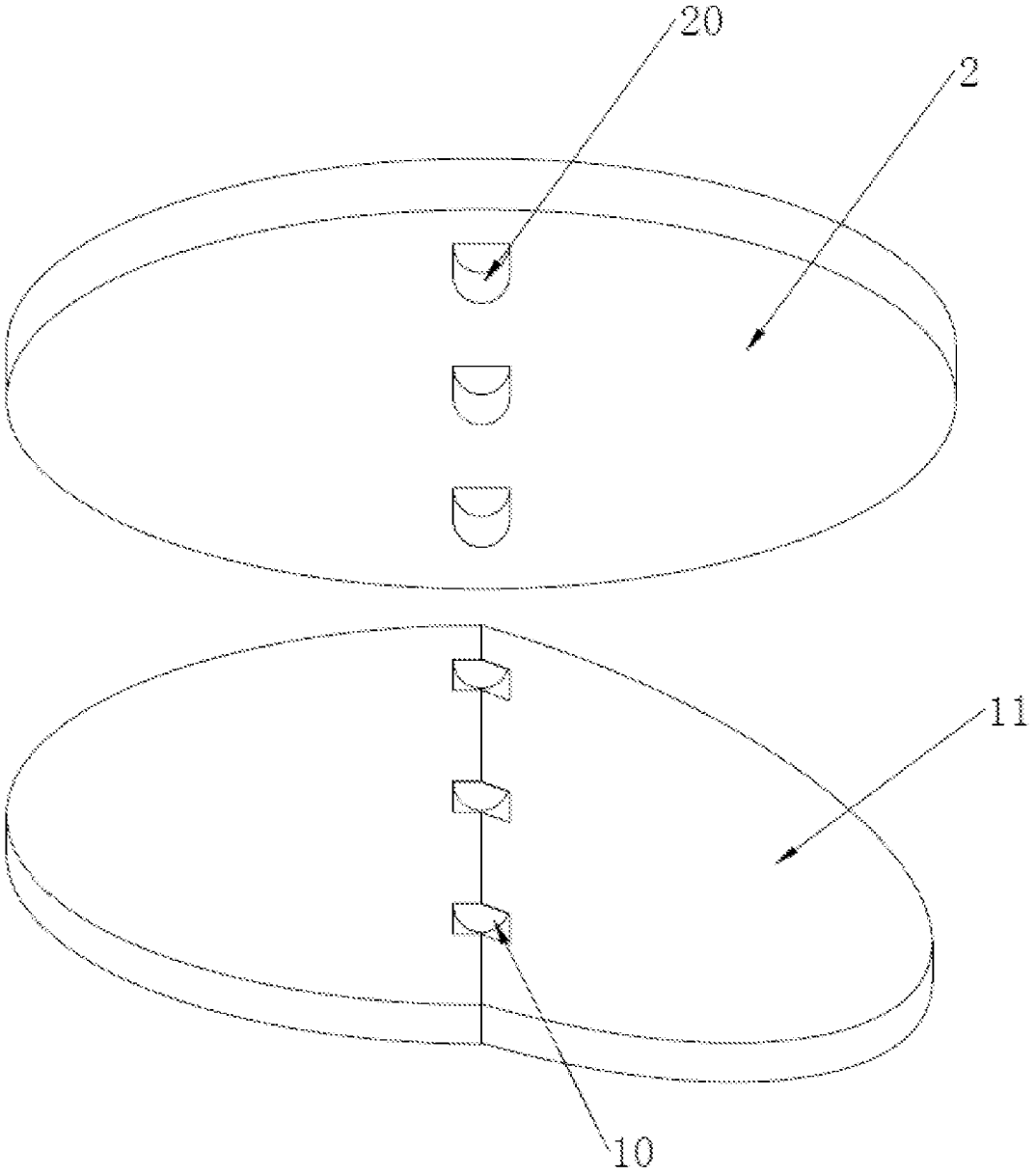
FIG. 5 is a schematic diagram showing one embodiment of the first and second connecting structures according to the present invention.
Figure 7:
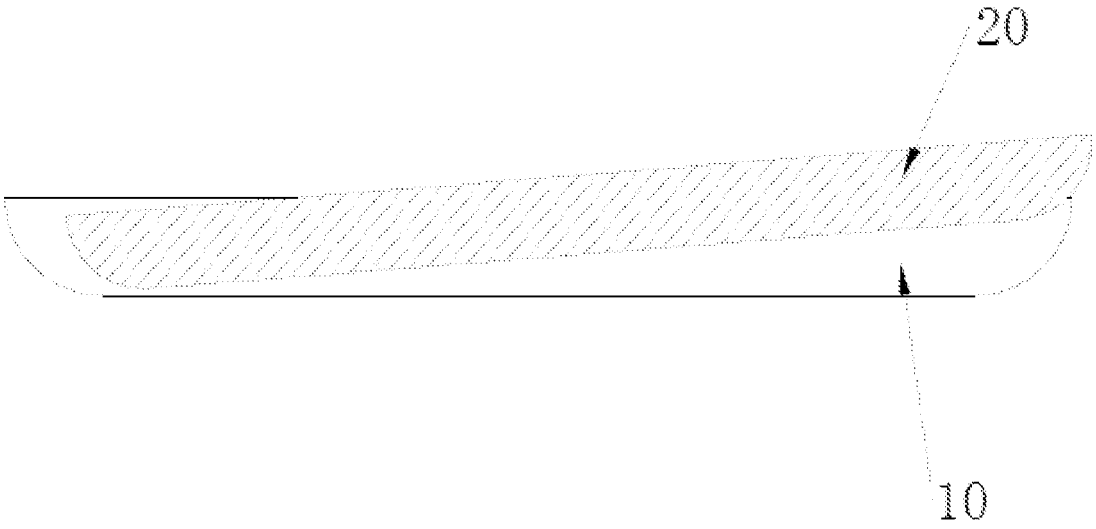
FIG. 7 is a schematic diagram showing misalignment of the first and second connecting structures in the prior art.
Figure 8:
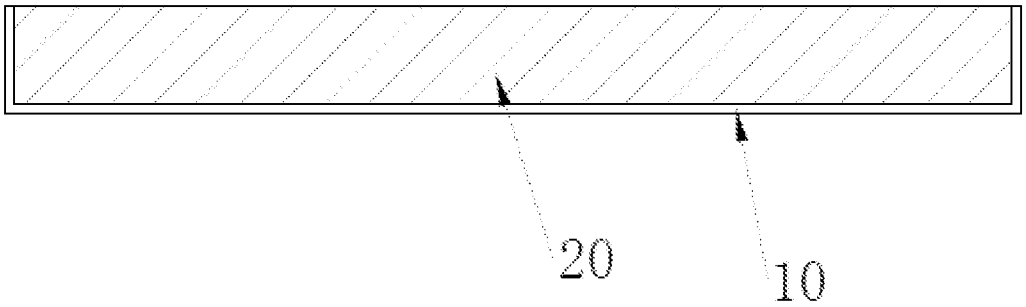
FIG. 8 is a schematic diagram showing the installation of the first and second connecting structures according to the present invention.

As shown in FIGS. 5 and 8, the first connecting structure 10 is a protrusion of arc cylindrical shape provided on an upper surface of the board body 11, and the second connecting structure 20 is a concave arc cylindrical shape provided on a lower surface of the cap body 2, so that the first connecting structure 10 and the second connecting structure 20 form a concave-convex corresponding cooperation. In other embodiments, the first connecting structure 10 is a groove of an arc cylindrical shape and the second connecting structure 20 is a protrusion of an arc cylindrical shape, so that the first connecting structure 10 and the second connecting structure 20 form a concave-convex corresponding cooperation. Further, the number of grooves and protrusions is not limited to one, and it is also possible to break a longer protrusion or groove into a plurality of protrusions or grooves provided at intervals, for example, a plurality of protrusions and a plurality of grooves are cooperated in one-to-one correspondence, or the number of grooves is larger than the number of protrusions. It is also possible to provide the protrusion with only a plurality of short arc cylindrical shapes provided at intervals, and the groove can then consist of a plurality of short grooves or only one elongated groove. The shape cooperation between the grooves and protrusions is such that the end of the first connecting structure 10 and the end of the second connecting structure 20 are a planar surface-to-planar surface cooperation, i.e., the two end surfaces of the arc cylindrical shape are planar surfaces perpendicular to a central axis of the arc cylindrical shape. In the prior art, as shown in FIG. 7, a person skilled in the art finds that the end of the first connecting structure 10 and the end of the second connecting structure 20 are in a sphere-to-sphere cooperation, and in a case where a predetermined gap between the groove and the protrusion is the same, the gap between the top end of the protrusion and the middle part of the groove is relatively large, and if the cap body 2 is not installed in place, there may be a case where the top end of the protrusion and the middle part of the groove are in an abutting cooperation, and in this case, there is a radial deviation of the cap body 2 with respect to the board body 11, resulting in the dislocation of the first and second sealing structures 30, 40, and finally a case where liquid leakage occurs in the liquid outlet 101 and the gas outlet 102.

In this example, the shape of the protrusion is set as an arc cylindrical shape, the arc surface is preferably an arc surface, the depth of the groove and the protrusion is not greater than the radius of the arc surface, the shape of the groove corresponds to the protrusion, and the central axis of the arc cylindrical shape coincides with the central axis of the hinge, so that the concave-convex cooperation between the groove and the protrusion can also form the hinge connection between the cap body 2 and the board body 11.

Figure 6:
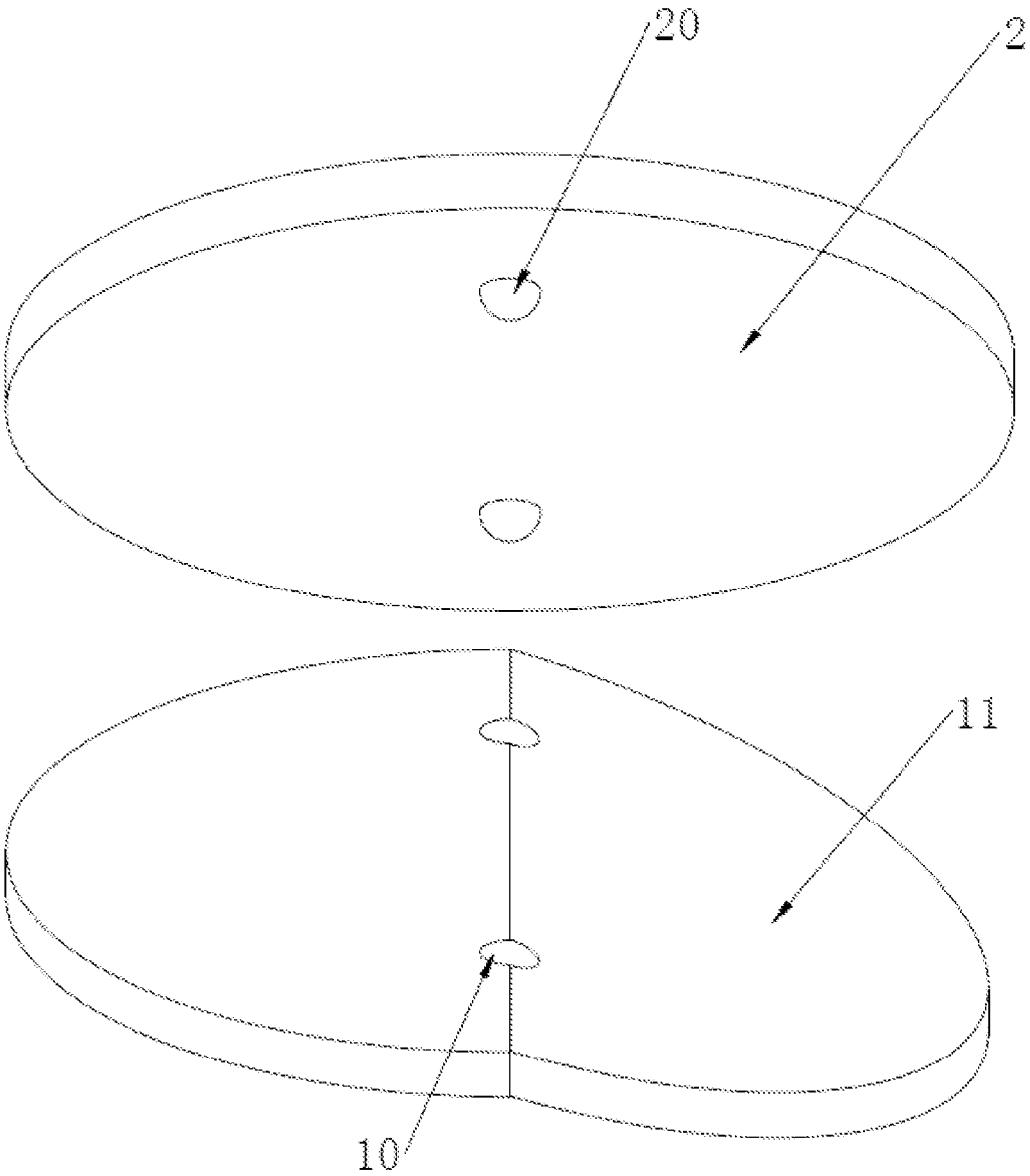
FIG. 6 is a schematic diagram showing another embodiment of the first and second connecting structures according to the present invention.

As shown in FIG. 6, the first connecting structure 10 may also be two spherical protrusions provided on an upper surface of the board body 11, the two spherical protrusions are provided at intervals along the radial direction of the board body 11, and the second connecting structure 20 is two spherical grooves provided on the lower surface of the cap body 2, the two grooves are provided at intervals along the radial direction of the cap body 2, so that the first connecting structure 10 and the second connecting structure 20 form a concave-convex corresponding cooperation. In other embodiments, the grooves, and protrusions of the board body 11 and the cap body 2 are opposite, i.e., the first connecting structure 10 is a two-spherical groove and the second connecting structure 20 is a two-spherical protrusion, so that the first connecting structure 10 and the second connecting structure 20 form a concave-convex corresponding cooperation. Further, the number of grooves and protrusions may be two or more.

In this example, the shape of the protrusion is set as a sphere, and the depth of the groove and the protrusion is not greater than the radius of the sphere, and the shape of the groove corresponds to that of the protrusion. Although the cooperation surfaces of the groove and the protrusion are sphere-to-sphere, there is a possibility that the protrusion will be ejected out of the groove, but as there are at least two spheres, compared to the elongated protrusion in the prior art, so that the groove can provide more resistance to the protrusion moving out of the groove.

As shown in FIGS. 9-16, the first and second sealing structures 30, 40 can be extruded from an end surface to an end surface to form a sealing cooperation, or can be extruded from a side wall to form a sealing cooperation, and when the first and second sealing structures 30, 40 are extruded to cooperate from a side wall, the second sealing structure 40 provided on the cap body 2 should protrude downwards to form a protruding portion, and the outer side wall of the protruding portion forms a sealing cooperation with the inner side wall of the first sealing structure 30. In order to form a sealing cooperation between the annular flange and the planar surface, an annular flange may be provided on a sealing surface of the first sealing structure 30 or the second sealing structure 40, wherein the sealing surface is an end surface or a side wall of the sealing structure, i.e., a surface forming a sealing cooperation by extrusion. In addition, in order for the first and second sealing structures 30, 40 to form a reliable extruded deformation sealing, the first and second sealing structures 30, 40 should be a soft and hard cooperation, specifically: the first sealing structure 30 is made of a hard material, and the second sealing structure 40 is made of a soft material; it is also possible that the first sealing structure 30 is made of a soft material and the second sealing structure 40 is made of a hard material. The hard material is, for example, metal or plastic, and the soft material is, for example, silica gel or rubber, the hard material and the soft material are not limited to the foregoing examples, but may also be other materials capable of forming a soft and hard extrusion cooperation as would occur to a person skilled in the art.

Figure 9:
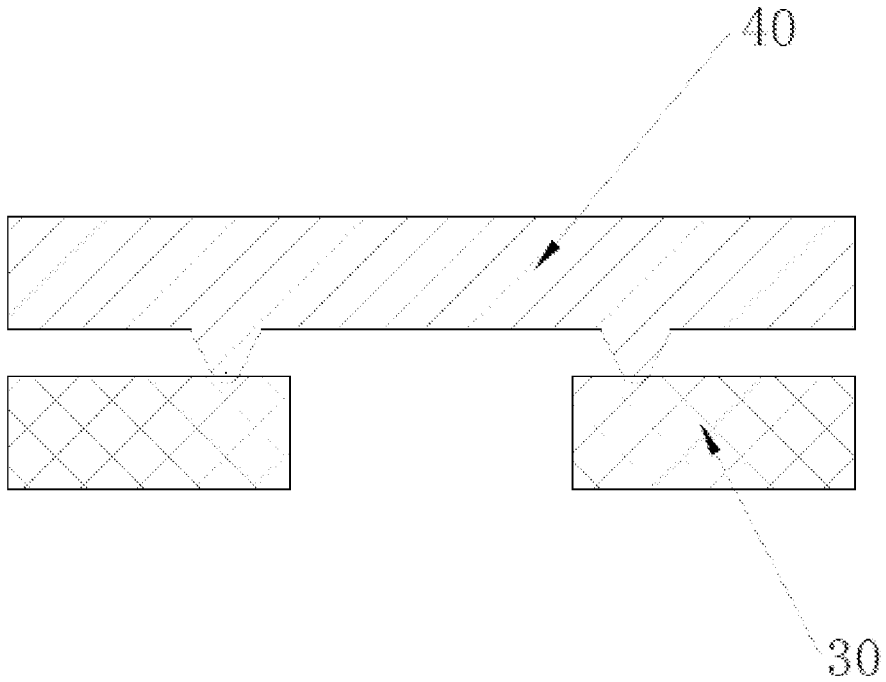
FIG. 9 is a first schematic diagram showing cooperation between the first and second sealing structures according to the present invention.

The cooperation between the first and second sealing structures 30, 40 is as follows:

as shown in FIG. 9, the first sealing structure 30 is made of a soft material, the second sealing structure 40 is made of a hard material, the first and second sealing structures 30, 40 are subjected to an end surface cooperation, and a lower end surface of the second sealing structure 40 is provided with an annular flange extruding an upper end surface of the first sealing structure 30 to deform the first sealing structure 30, thereby forming an extruded deformation sealing cooperation between the first and second sealing structures 30, 40.

Figure 10:
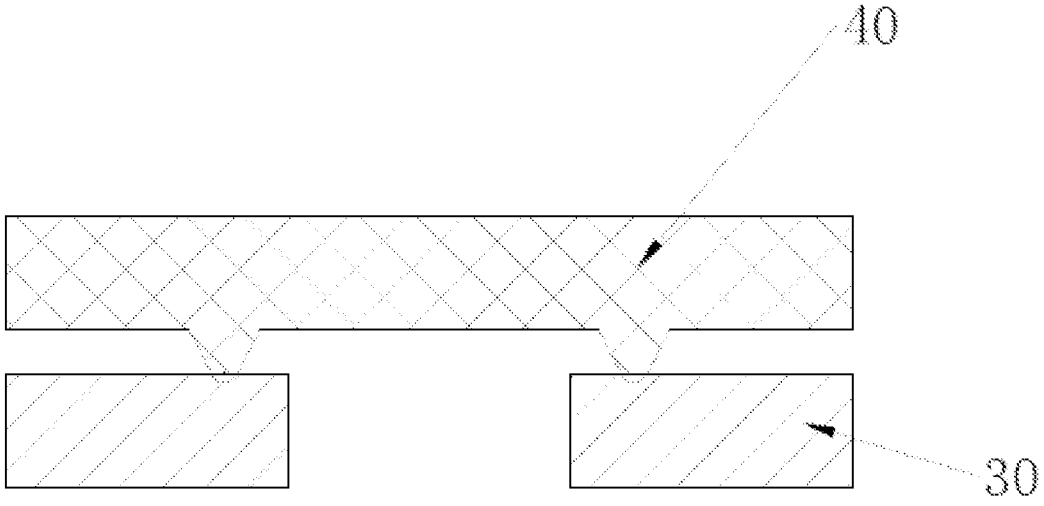
FIG. 10 is a second schematic diagram showing cooperation between the first and the second sealing structures according to the present invention.

As shown in FIG. 10, the first sealing structure 30 is made of a hard material, the second sealing structure 40 is made of a soft material, the first and second sealing structures 30, 40 are subjected to an end surface cooperation, and a lower end surface of the second sealing structure 40 is provided with an annular flange, and an upper end surface of the first sealing structure 30 extrudes the annular flange of the second sealing structure 40 to deform the annular flange, thereby forming an extruded deformation sealing cooperation between the first and second sealing structures 30, 40.

Figure 11:
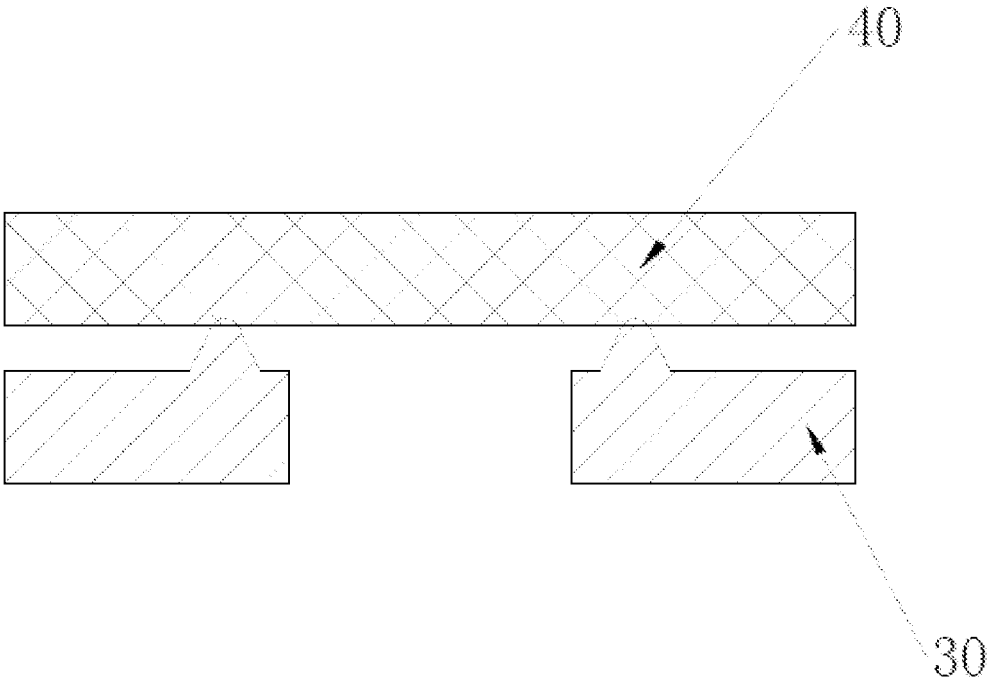
FIG. 11 is a third schematic diagram showing cooperation between the first and second sealing structures according to the present invention.

As shown in FIG. 11, the first sealing structure 30 is made of a hard material, the second sealing structure 40 is made of a soft material, the first and second sealing structures 30, 40 are subjected to an end surface cooperation, and an upper end surface of the first sealing structure 30 is provided with an annular flange, and the annular flange of the first sealing structure 30 extrudes to deform a lower end surface of the second sealing structure 40, thereby forming an extruded deformation sealing cooperation between the first and second sealing structures 30, 40.

Figure 12:
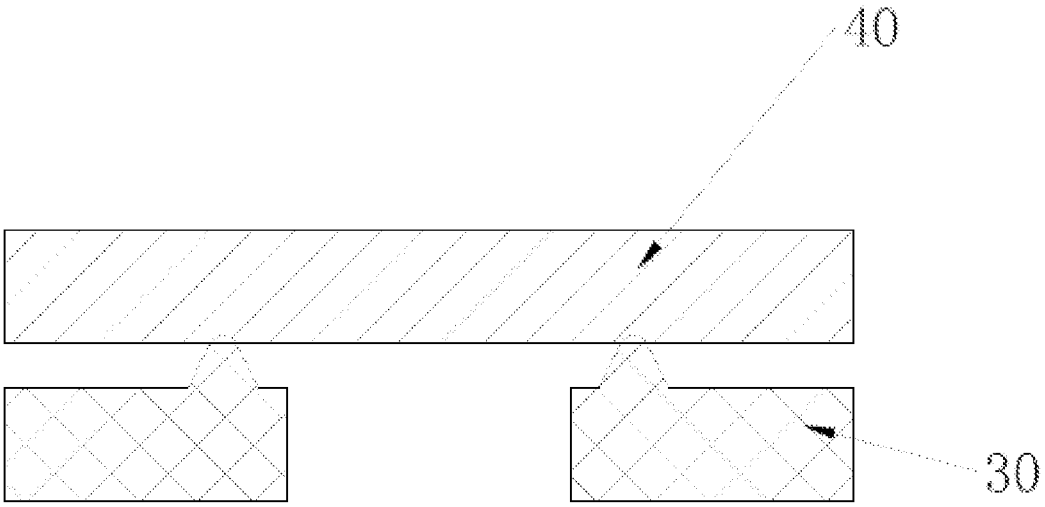
FIG. 12 is a fourth schematic diagram showing cooperation between the first and second sealing structures according to the present invention.

As shown in FIG. 12, the first sealing structure 30 is made of a soft material, the second sealing structure 40 is made of a hard material, the first and second sealing structures 30, 40 are subjected to an end surface cooperation, and an upper end surface of the first sealing structure 30 is provided with an annular flange, and a lower end surface of the second sealing structure 40 extrudes the annular flange of the first sealing structure 30 to deform the annular flange, thereby forming an extrusion deformation sealing cooperation between the first and second sealing structures 30, 40.

Figure 13:
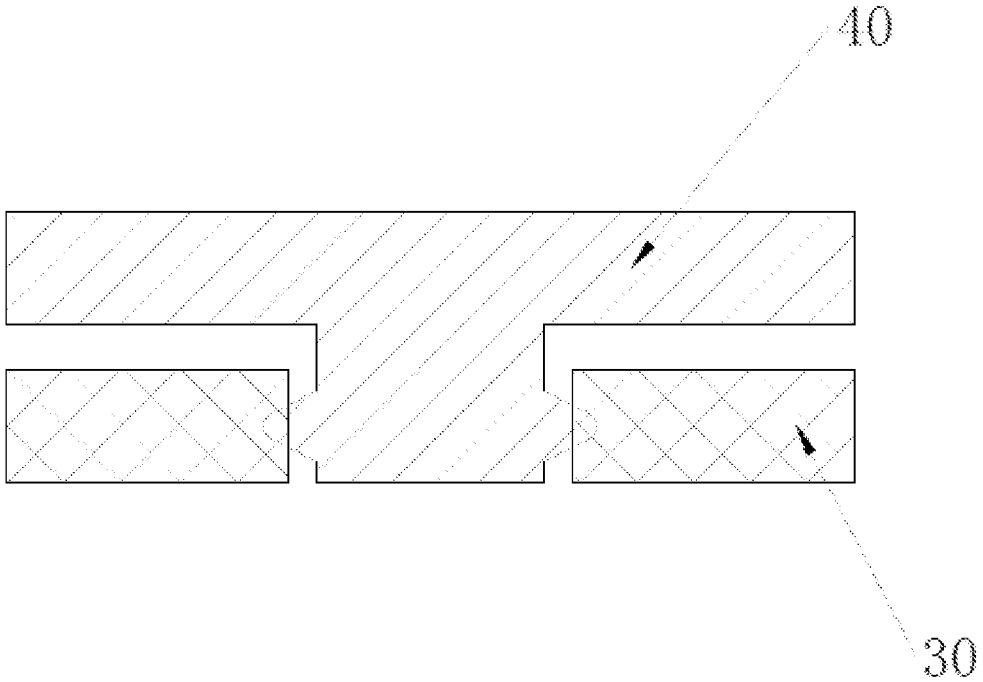
FIG. 13 is a fifth schematic diagram showing cooperation between the first and second sealing structures according to the present invention.

As shown in FIG. 13, the first sealing structure 30 is made of a soft material, the second sealing structure 40 is made of a hard material, the first and second sealing structures 30, 40 are subjected to a side wall cooperation, an outer side wall of the protruding portion of the second sealing structure 40 is provided with an annular flange, and the annular flange of the second sealing structure 40 extrudes to deform an inner side wall of the first sealing structure 30, thereby forming an extruded deformation sealing cooperation between the first and second sealing structures 30, 40.

Figure 14:
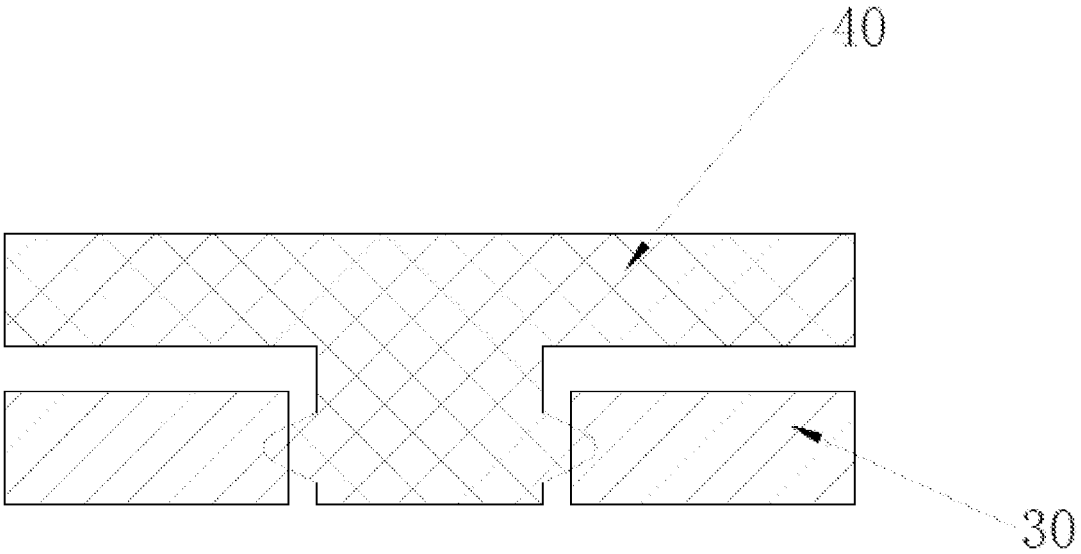
FIG. 14 is a sixth schematic diagram showing cooperation between the first and second sealing structures according to the present invention.

As shown in FIG. 14, the first sealing structure 30 is made of a hard material, the second sealing structure 40 is made of a soft material, the first and second sealing structures 30, 40 are subjected to a side wall cooperation, an outer side wall of the protruding portion of the second sealing structure 40 is provided with an annular flange, and the inner side wall of the first sealing structure 30 extrudes to deform the annular flange of the second sealing structure 40, thereby forming an extruded deformation sealing cooperation between the first and second sealing structures 30, 40.

Figure 15:
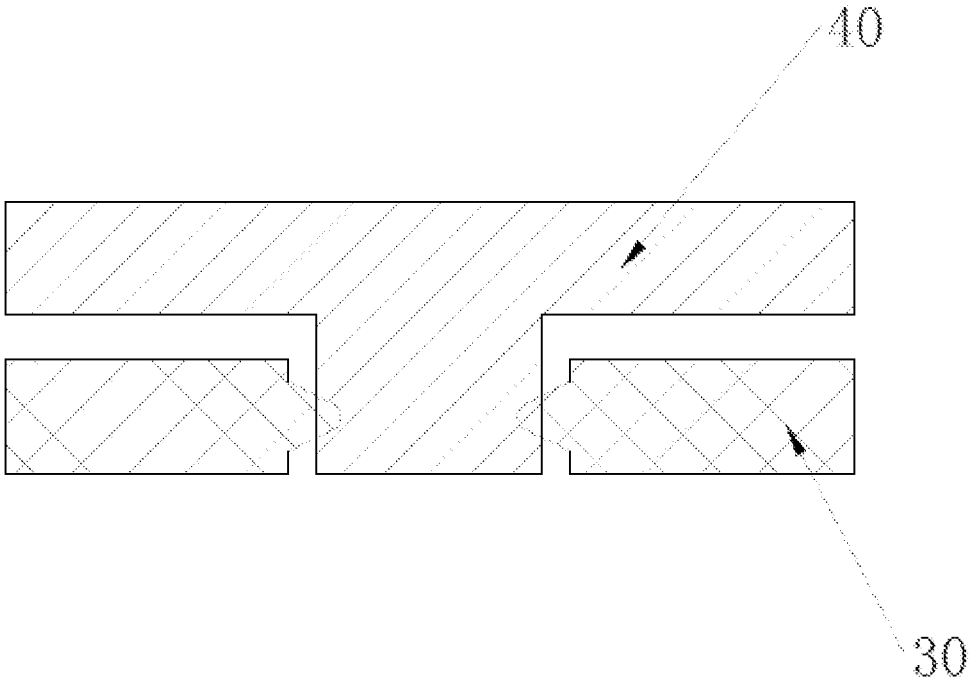
FIG. 15 is a seventh schematic diagram showing cooperation between the first and second sealing structures according to the present invention.

As shown in FIG. 15, the first sealing structure 30 is made of a soft material, the second sealing structure 40 is made of a hard material, the first and second sealing structures 30, 40 are subjected to a side wall cooperation, the inner side wall of the first sealing structure 30 is provided with an annular flange, and the inner side wall of the second sealing structure 40 extrudes the annular flange of the first sealing structure 30 to deform the annular flange, thereby forming an extruded deformation sealing cooperation between the first and second sealing structures 30, 40.

Figure 16:
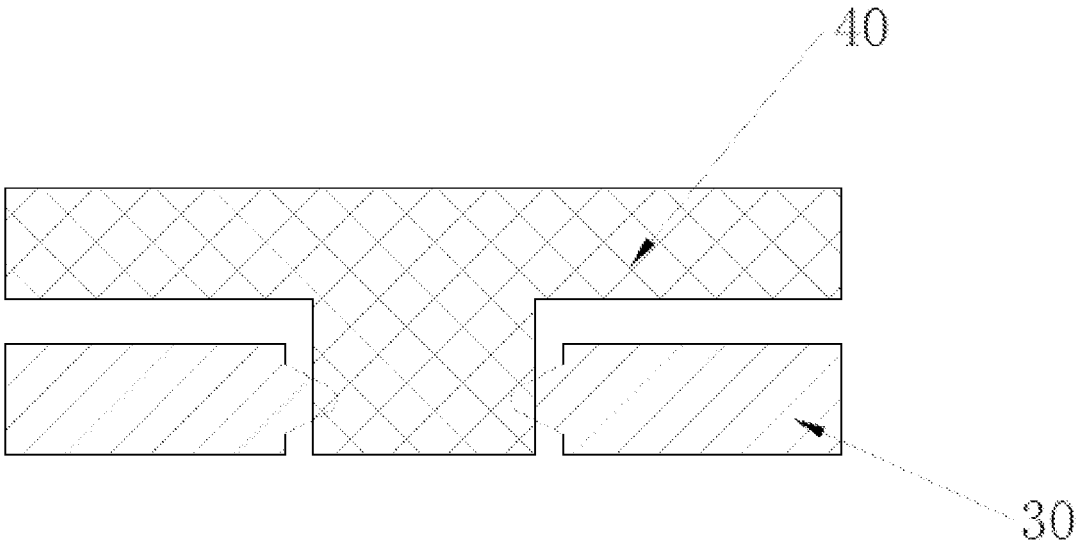
FIG. 16 is an eighth schematic diagram showing cooperation between the first and second sealing structures according to the present invention together.

As shown in FIG. 16, the first sealing structure 30 is made of a hard material, the second sealing structure 40 is made of a soft material, the first and second sealing structures 30, 40 are subjected to a side wall cooperation, an inner side wall of the first sealing structure 30 is provided with an annular flange, and the annular flange of the first sealing structure 30 extrudes to deform the inner side wall of the second sealing structure 40, thereby forming an extruded deformation sealing cooperation between the first and second sealing structures 30, 40.

Figure 17:
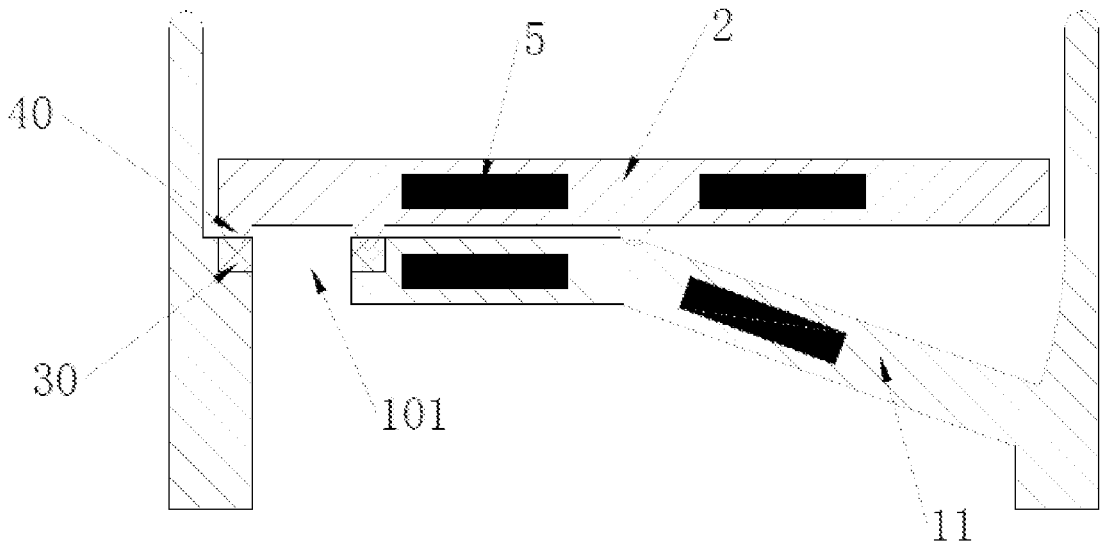
FIG. 17 is a first schematic diagram showing cooperation between the board body and the cap body according to an embodiment of the present invention.

A plurality of ways of cooperation between the first and second sealing structures 30, 40 are listed, and each of the liquid outlet 101 and the gas outlet 102 is sealed in any one of the above ways to prevent undesired leakage of the liquid outlet 101 and the gas outlet 102. The sealing manner between each of the liquid outlet 101 and the gas outlet 102 may be the same or different. In the embodiment as shown in FIG. 17, the first sealing structure 30 at the liquid outlet 101 is made of a soft material, the second sealing structure 40 on the cap body 2 is made of a hard material, and the second sealing structure is provided with an annular flange. In the embodiment as shown in FIG. 18, the first sealing structure 30 at the liquid outlet 101 is made of a hard material, the second sealing structure 40 on the cap body 2 is made of a soft material, and the second sealing structure is provided with an annular flange.

Figure 4:
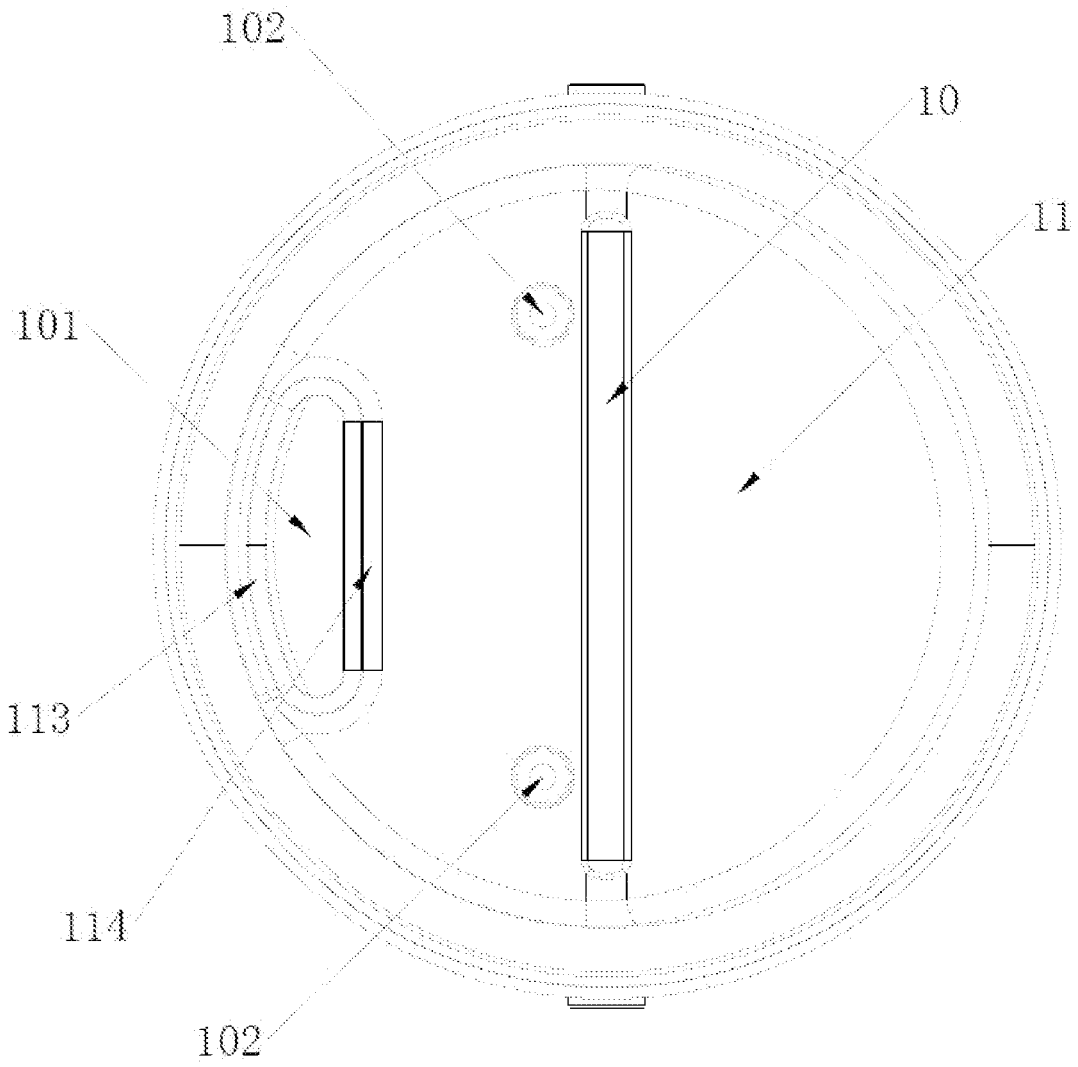
FIG. 4 is a top view showing a cap body according to an embodiment of the present invention.

As shown in FIG. 4, the board body 11 is provided with a flow guide portion 113 and a cooperation portion 114 surrounding the liquid outlet 101, wherein the liquid in the cup body flows through the flow guide portion 113 and then is poured out or can be consumed by a person, and the cooperation portion 114 is connected to the flow guide portion 113 and surrounds the liquid outlet 101. At a top view angle of the board body 11, the flow guide portion 113 is provided on a side of the liquid outlet 101 close to the annular wall 12, and extends in both directions along the circumference of the liquid outlet to a position slightly away from the annular wall 12. In the circumference of the liquid outlet 101, except for the region of the flow guide portion 113, the rest is a cooperation portion 114, and the flow guide portion 113 and the cooperation portion 114 are engaged to form a side wall of the liquid outlet 101, and the flow guide portion 113 extends outward to engage the annular wall 12.

Figure 19:
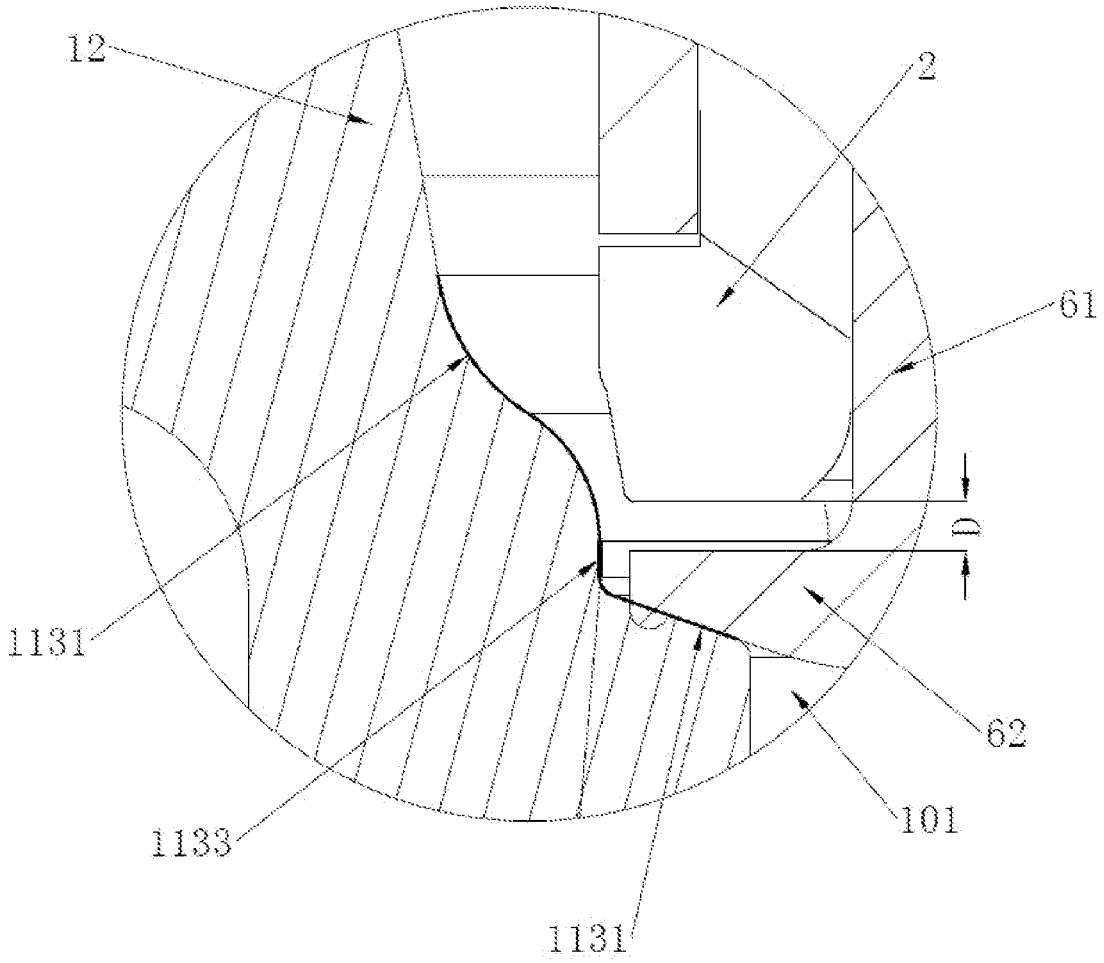
FIG. 19 is a partial enlarged view A of FIG. 3.
Figure 20:
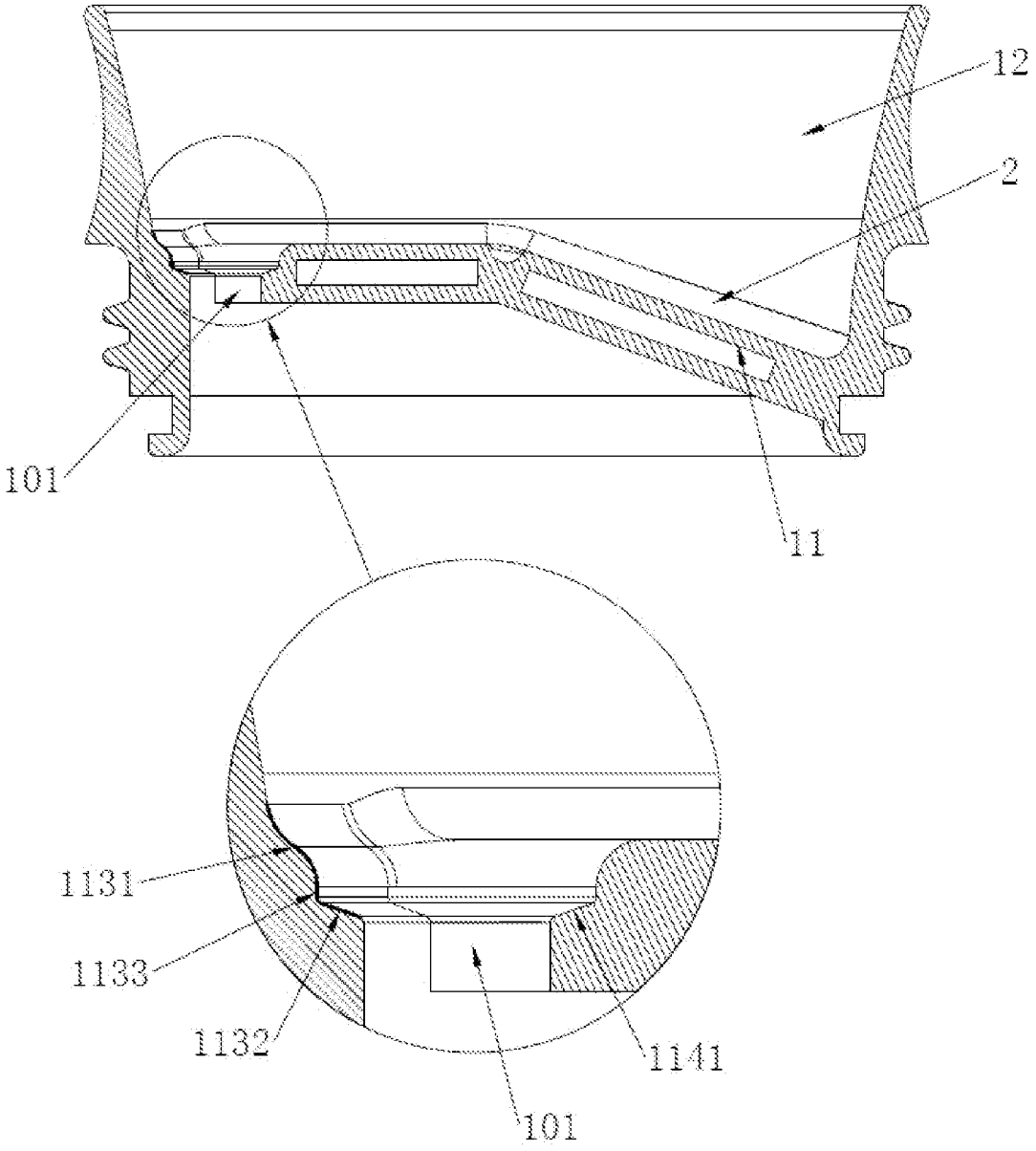
FIG. 20 is a sectional view showing structure of a board body according to an embodiment of the present invention.

As shown in FIGS. 19 and 20, in a radial section of the liquid outlet 101, a thick solid line in the figure shows a profile of the flow guide portion 113, and the flow guide portion 113 includes a drainage section 1131, a first sealing section 1132, and a transition section 1133 connected to the drainage section 1131 and the first sealing section 1132, and the slope of the first sealing section 1132 is smaller relative to the drainage section 1131 to form a relatively gentle sealing surface. The drainage section 1131 extends inward and downward from the lower end of the annular wall 12 to form a drainage slope, the transition section 1133 extends vertically downward from the lower end of the drainage section 1131 so that the drainage section 1131 and the first sealing section 1132 form a height difference, the drainage section 1131 is more specifically divided into an inner concave section and an outer convex section, the inner concave section is connected tangentially to the annular wall 12, the outer convex section is connected tangentially to the transition section, and the inner concave section and the outer convex section are connected tangentially, so that the flow guide portion 113 forms a smooth profile extending outward gradually from bottom to top, facilitating the outflow of the liquid and also preventing the accumulation of the liquid on the flow guide portion 113. The first sealing section 1132 extends from the lower end of the transition section 1133 towards the inner side of the liquid outlet 101 to form a step, the cooperation portion 114 is provided with a second sealing section 1141, and the first sealing section 1132 and the second sealing section 1141 are connected to form a first sealing structure 30 surrounding the liquid outlet 101. As shown in FIG. 20, the first sealing section 1132 may be an oblique line extending obliquely inward and downward from the lower end of the transition section 1133. It may also be a straight line extending horizontally inward from the lower end of the transition section 1133.

As shown in FIG. 19, a seal 6 is provided on the lower surface of the cap body 2, the lower surface of the seal 6 is used for cooperating with the first sealing structure 30, and the lower surface of the seal 6 forms the second sealing structure 40, so that the end surface of the first sealing structure 30 forms a sealing cooperation with the end surface of the second sealing structure 40. The second sealing structure 40 is provided with an annular flange, in which case the first sealing structure 30 is a planar surface, and the planar surface according to the present invention refers to a straight line or oblique line with a non-curved profile in a radial section of the liquid outlet.

When the first sealing section 1132 is a straight line extending horizontally inward from the lower end of the transition section 1133, the first sealing structure 30 forms an annular planar surface extending circumferentially inward from the liquid outlet 101, and the planar surface extends horizontally. Since the annular planar surface of the first sealing structure 30 extends horizontally when the seal 6 is displaced in the radial direction of the liquid outlet 101, a small displacement of the seal 6 also does not affect the sealing cooperation formed by the first and second sealing structures 30, 40.

As shown in FIG. 20, when the first sealing section 1132 is an oblique line extending obliquely inward and downward from the lower end of the transition section 1133, the first sealing structure 30 forms an annular planar surface extending circumferentially inward from the liquid outlet 101, and the planar surface extends inward and downward (which may also be referred to as a conical surface). When finished drinking, the cup body 100 is again in a standing state, and the conical surface has a drainage function for the residual liquid on the flow guide portion 113 and the annular wall 12, preventing a large amount of liquid from accumulating on the board body 11, and spoil the user's experience.

The present invention divides the flow guide portion 113 into a drainage section 1131, a transition section 1133 and a first sealing section 1132 in a liquid outlet radial direction, thereby forming a profile having an oblique tendency to facilitate the outflow of the liquid to the annular wall 12, and to facilitate the backflow of the liquid into the cup body 100 after drinking.

Figure 21:
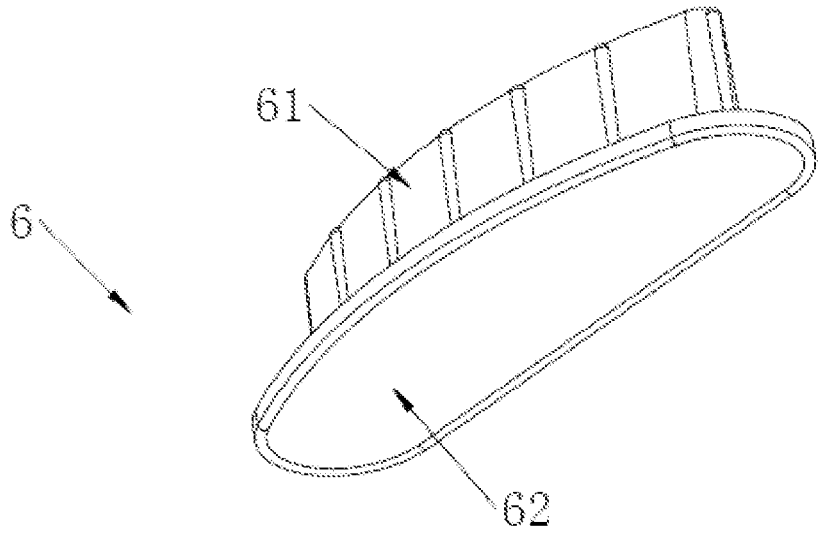
FIG. 21 is a schematic diagram showing a structure of a seal according to an embodiment of the present invention.

As shown in FIGS. 19 and 21, the seal 6 includes a mounting portion 61 and a sealing portion 62, wherein the mounting portion 61 is embedded in the cap body 2 correspondingly provided with a groove for receiving the mounting portion 61, the outer peripheral wall of the mounting portion 61 is further provided with a plurality of ribs, and the mounting portion 61 cooperates with the groove by compressing the ribs. The sealing portion 62 is formed to extend downward from the mounting portion 61, and in the radial direction of the liquid outlet 101, the sealing portion 62 extends circumferentially outward relative to the mounting portion 61 to form a skirt, and a gap D for receiving deformation of the sealing portion 62 is provided between the sealing portion 62 and the cap body 2. The lower surface of the sealing portion 62 is provided with an annular flange to form the second sealing structure 40, and the annular flange corresponds to the gap; when the seal 6 is engaged with the first sealing structure 30, the annular flange of the sealing portion 62 is extruded and the sealing portion 62 is deformed upwards; at this time, the skirt of the sealing portion 62 abuts against the lower surface of the cap body 2, and the annular flange is pressed and collapsed and deformed to form a seal of the liquid outlet 101.

As shown in FIG. 22, the board body 11 is provided with an inclined hole being gradually oblique towards the annular wall 12 of the cup cap from bottom to top, and the inclined hole forms the liquid outlet 101. At this time, the inner peripheral wall of the inclined hole forms the first sealing structure 30, and the sealing surface of the first sealing structure 30 is a planar surface. The seal 6 protrudes downward from the lower surface of the cap body 2, is inserted into the inclined hole so that the outer peripheral wall of the seal 6 forms a sealing connection with the inner peripheral wall of the inclined hole, the outer peripheral wall of the seal 6 is provided with an annular protrusion and forms the second sealing structure 40, and the sealing surface of the second sealing structure 40 is a flange surface, so that the inner peripheral wall of the first sealing structure 30 and the outer peripheral wall of the second sealing structure 40 form an annular flange and planar extruded cooperation seal.

In this example, since the seal 6 is protruded long downward, in order to allow the cap body 2 to pivot smoothly with respect to the board body 11, the upper surface of the board body 11 is provided with an oblique surface, which obliques upward gradually from one side of the liquid outlet 101 to the other side, in addition to setting the direction of the inclined hole to be gradually oblique toward the annular wall 12 of the cap from the bottom to the top.

The invention claimed is:

1. A magnetic cup cap, comprising a body and a cap body, wherein the body comprises a board body, an annular wall extends upwards from a circumference of the board body, a connecting portion extends downwards from the circumference of the board body, at least one liquid outlet is provided on an upper surface of the board body, and a first sealing structure is annularly provided on a circumference of the at least one liquid outlet;

the cap body is used for capping the board body, and the cap body and the board body are magnetically engaged, the cap body is provided with a second sealing structure, and cooperation between the first sealing structure and the second sealing structure is an extruded cooperation between an annular flange and a planar surface;

the board body is provided with a first connecting structure, the cap body is provided with a second connecting structure, and the first connecting structure and the second connecting structure cooperate to form a hinged connection between the board body and the cap body;

the board body has a first closing portion and a first opening portion bounded by the first connecting structure, the cap body has a second closing portion and a second opening portion bounded by the second connecting structure, an included angle is formed between at least one of:

the first closing portion and the first opening portion, or the second closing portion and the second opening portion; and the at least one liquid outlet and a gas outlet are provided at the first closing portion of the board body, and the second sealing structure is provided at the second closing portion of the cap body.

2. The magnetic cup cap according to claim 1, wherein an end surface of the first sealing structure and an end surface of the second sealing structure form a sealing cooperation, and either the end surface of the first sealing structure or the end surface of the second sealing structure is provided with an annular protrusion to form the annular flange.

3. The magnetic cup cap according to claim 1, wherein the second sealing structure is provided with a downwardly projecting protruding portion and an outer side wall of the downwardly projecting protruding portion of the second sealing structure or an inner side wall of the first sealing structure is provided with an annular protrusion to form the annular flange.

4. The magnetic cup cap according to claim 1, wherein materials of the first sealing structure and the second sealing structure are respectively one of:

the first sealing structure is made of silica gel or rubber, and the second sealing structure is made of plastic or metal; or the first sealing structure is made of plastic or metal, and the second sealing structure is made of silicone or rubber.

5. The magnetic cup cap according to claim 1, wherein the first connecting structure is at least two spherical protrusions or spherical grooves provided along a radial direction of the board body, the second connecting structure is at least two spherical grooves or spherical protrusions provided along a radial direction of the cap body, and the first connecting structure and the second connecting structure are in a concave-convex corresponding cooperation.

6. The magnetic cup cap according to claim 1, wherein the upper surface of the board body is a planar or oblique surface so that the first closing portion is parallel with the first opening portion of the board body.

7. The magnetic cup cap according to claim 1, wherein the board body is provided with a flow guide portion and a cooperation portion surrounding the at least one liquid outlet;

on a radial section of the at least one liquid outlet, the flow guide portion comprises a drainage section and a first sealing section, wherein the drainage section extends inwards and downwards from a lower end of the annular wall, the first sealing section is provided below the drainage section and extends towards an inside of the at least one liquid outlet, and a slope of the first sealing section is smaller than that of the drainage section;

the cooperation portion is provided with a second sealing section in the radial section of the at least one liquid outlet;

the first sealing section and the second sealing section are joined to form the first sealing structure around the at least one liquid outlet.

8. The magnetic cup cap according to claim 7, wherein the flow guide portion further comprises a transition section connected to the drainage section and the first sealing section in the radial section of the at least one liquid outlet, and the transition section extends vertically downward from a lower end of the drainage section.

9. The magnetic cup cap according to claim 8, wherein the drainage section comprises an inner concave section and an outer convex section, the outer convex section is tangentially connected to the transition section, the inner concave section is tangentially connected to the outer convex section, the inner concave section is also tangentially connected to the annular wall such that the drainage section forms a smooth profile that gradually extends outwardly from bottom to top.

10. The magnetic cup cap according to claim 7, wherein the first sealing section is an oblique line extending obliquely downward in a direction toward the inside of the at least one liquid outlet in the radial section of the at least one liquid outlet.

11. The magnetic cup cap according to claim 7, wherein the first sealing section is a horizontally extending straight line in the radial section of the at least one liquid outlet.

12. The magnetic cup cap according to claim 7, wherein a seal is provided on a lower surface of the cap body, a lower surface of the seal is used to cooperate with the first sealing structure and form the second sealing structure, and an end surface of the first sealing structure forms a sealing cooperation with an end surface of the second sealing structure.

13. The magnetic cup cap according to claim 12, wherein the second sealing structure is provided with the annular flange;

in the radial section of the at least one liquid outlet, the first sealing section is an oblique line extending obliquely inwards and downwards or a straight line extending horizontally inwards, so that a sealing surface of the first sealing structure forms the planar surface.

14. The magnetic cup cap according to claim 12, wherein the seal comprises a mounting portion and a sealing portion, the mounting portion is embedded in the cap body, the sealing portion is formed extending downward from the mounting portion and extending circumferentially outward relative to the mounting portion in a radial direction of the at least one liquid outlet, and a gap for receiving deformation of the sealing portion is provided between the sealing portion and the cap body.

15. The magnetic cup cap according to claim 1, wherein the board body is provided with an inclined hole being gradually oblique toward the annular wall of the magnetic cup cap from bottom to top to form the at least one liquid outlet.

16. The magnetic cup cap according to claim 15, wherein an inner peripheral wall of the inclined hole forms the first sealing structure, and a sealing surface of the first sealing structure is a second planar surface;

a seal is provided on a lower surface of the cap body and is used to be inserted into the inclined hole so that an outer peripheral wall of the seal and the inner peripheral wall of the inclined hole form a sealing connection, the outer peripheral wall of the seal is provided with an annular protrusion and forms the second sealing structure, and a sealing surface of the second sealing structure is a flange surface, so that an inner peripheral wall of the first sealing structure and an outer peripheral wall of the second sealing structure form a sealing cooperation.

17. The magnetic cup cap according to claim 1, wherein at least one gas outlet is provided on the upper surface of the board body, and the first sealing structure is provided in a circumference of the at least one gas outlet.

18. A magnetic cup cap, comprising a body and a cap body, wherein the body comprises a board body, an annular wall extends upwards from a circumference of the board body, a connecting portion extends downwards from the circumference of the board body, at least one liquid outlet is provided on an upper surface of the board body, and a first sealing structure is annularly provided on a circumference of the at least one liquid outlet;

the cap body is used for capping the board body, and the cap body and the board body are magnetically engaged, the cap body is provided with a second sealing structure, and cooperation between the first sealing structure and the second sealing structure is an extruded cooperation between an annular flange and a planar surface;

the board body is provided with a first connecting structure, the cap body is provided with a second connecting structure, the first connecting structure and the second connecting structure form a concave-convex cooperation, and an end of the first connecting structure and an end of the second connecting structure form a planar surface-to-planar surface cooperation.

19. The magnetic cup cap according to claim 18, wherein the first connecting structure is at least one of a protrusion or a groove of an arc cylindrical shape, and both end surfaces of the arc cylindrical shape are planar surfaces perpendicular to a central axis of the arc cylindrical shape, and the second connecting structure is a groove or a protrusion corresponding to the first connecting structure, and the first connecting structure and the second connecting structure form a concave-convex corresponding cooperation.

20. A magnetic cup cap, comprising a body and a cap body, wherein the body comprises a board body, an annular wall extends upwards from a circumference of the board body, a connecting portion extends downwards from the circumference of the board body, at least one liquid outlet is provided on an upper surface of the board body, and a first sealing structure is annularly provided on a circumference of the at least one liquid outlet;

the cap body is used for capping the board body, and the cap body and the board body are magnetically engaged, the cap body is provided with a second sealing structure, and cooperation between the first sealing structure and the second sealing structure is an extruded cooperation between an annular flange and a planar surface;

the board body is provided with a flow guide portion and a cooperation portion surrounding the at least one liquid outlet;

on a radial section of the at least one liquid outlet, the flow guide portion comprises a drainage section and a first sealing section, wherein the drainage section extends inwards and downwards from a lower end of the annular wall, the first sealing section is provided below the drainage section and extends towards an inside of the at least one liquid outlet, and a slope of the first sealing section is smaller than that of the drainage section;

the cooperation portion is provided with a second sealing section in the radial section of the at least one liquid outlet;

the first sealing section and the second sealing section are joined to form the first sealing structure around the at least one liquid outlet.

* * * * *